US006890116B1

(12) United States Patent
Petroskey et al.

(10) Patent No.: US 6,890,116 B1
(45) Date of Patent: May 10, 2005

(54) WRITING INSTRUMENT WITH ROTATABLE DESIGN ELEMENT

(76) Inventors: Allen Petroskey, 4275 Via Arbolada, #111, Los Angeles, CA (US) 90042; Liwen Liao, 24 E. Elgin St., Unit #2, Alhambra, CA (US) 91801; Edward Busath, 488 Barron Park Ct., San Jose, CA (US) 95136

( * ) Notice: Subject to any disclaimer, the term of this patent is extended or adjusted under 35 U.S.C. 154(b) by 95 days.

(21) Appl. No.: 10/686,210

(22) Filed: Oct. 15, 2003

(51) Int. Cl.[7] ..... B43K 24/02; B43K 5/16
(52) U.S. Cl. ..... 401/104; 401/195
(58) Field of Search ..... 401/104–106, 401/195, 52; 24/11 PP, 11 HC, 11 R

(56) References Cited

U.S. PATENT DOCUMENTS 1,262,788 A 4/1918 Heidenreich
1,388,219 A * 8/1921 Thompson ..... 40/1.5
1,421,318 A * 6/1922 Steffan et al. ..... 40/334
2,764,827 A 10/1956 Custin
2,896,348 A 7/1959 Herne
3,156,960 A * 11/1964 Klitzner ..... 24/11 R
5,074,695 A * 12/1991 DeRosa ..... 401/195
5,086,577 A 2/1992 Abernethy
6,702,499 B1 * 3/2004 Fang ..... 401/243

FOREIGN PATENT DOCUMENTS

JP 10278483 A * 10/1998 ..... B43K/25/02

* cited by examiner

*Primary Examiner*—Gregory L. Huson
*Assistant Examiner*—Huyen Le
(74) *Attorney, Agent, or Firm*—Robert A. Seldon

(57) ABSTRACT

A writing instrument having a rotatable design element, such as a logo, on its pocket clip is disclosed. The design element is mounted for rotation on a spondle portion that protrudes through the clip. A rod having its proximal end coupled to the writing tip for longitudinal movement therewith extends through the writing instrument's body at a position masked by the pocket clip. The distal end of the rod is coupled to the spindle to induce rotational movement of the design element when the writing tip moves longitudinally.

5 Claims, 4 Drawing Sheets

WRITING INSTRUMENT WITH ROTATABLE DESIGN ELEMENT

This invention is related to writing instruments exhibiting indicia, and more specifically to pens and pencils with retractable tips which bear advertising or novelty indicia on their exteriors.

BACKGROUND OF THE INVENTION

Pens and pencils are popular novelty items used to advertise companies, political parties and the like as well as display various design elements and logos that motivate people to purchase and/or use the instrument. In many cases, these pens and pencils are used to create good will between the perceived donor of the writing instrument and potential or actual customers or other recipients to whom they are given. Accordingly, there is a constant search for novel writing instruments that can be used to attract attention and foster good while meeting practical budget constraints of the donor This invention is more specifically directed to writing instruments having a retractable writing tip. Some pens, such as ballpoint pens, and some types of pencils include a retractable writing tip that is operated by the downward pressing of a manually actuated button at the top of the instrument or, alternatively, by the rotation of a part of the writing instrument's body with respect to another part of the body. For clarity, the terms "top" and "bottom" will be used in the context of a pen's conventional writing position with its writing point at the bottom, although it is clear that the pen can be oriented otherwise during use and/or storage.

FIG. 1 hereto is an example of a prior art ballpoint pen, and is utilized to identify the basic parts of the pen as comprising a generally tubular body 10 disposed about a longitudinal axis 25, and consisting of a lower body portion 11 and an upper body portion 13. The upper and lower body portions are typically separable, with the top portion typically screwing into the bottom portion or vice-versa. A clip 14 is secured to the upper body portion by any of a number of suitable and well-known methods. A cartridge unit 20 having an ink reservoir is positioned within the body 10 of the pen, and terminates at its bottom in a writing tip 22. The cartridge forms a reservoir 21 for the ink dispensed by the pen at its tip, and is typically replaceable when the upper and lower body portions are separable.

The cartridge unit 20 is mounted for longitudinal sliding reciprocal movement within the body 10 of the pen. A spring 24 surrounds the lower end of the cartridge, and is captured between the lower narrowed end of the lower body 11 and a radially enlarged portion 23 of the cartridge unit 20. The spring 24 is sufficiently compressed to urge the cartridge upward and, consequently, to urge the writing tip upward into a retracted position within the bottom region of the lower body portion 11.

The upper body portion 13 typically contains the protracting and retracting mechanism by which the writing tip is selectively deployed and retracted in the longitudinal direction, and numerous structures for accomplishing this function are known in the art. As will be apparent, the invention herein is not limited to any particular protraction/retraction mechanism, but is responsive to the longitudinal movement of the cartridge or equivalent pencil structure however induced. In FIG. 1, the longitudinal movement is induced by the manual pressing of button 30 which protrudes through a central hole formed in the top of the pen's body. As known to those of ordinary skill in the art, the pressing of the button causes the interior end of the button to push downward on the cartridge unit 20 against the spring 24. When the button is released, and the spring moves the cartridge upward, the cartridge's upward progress is blocked by a gearing arrangement that has been rotated during the downward longitudinal movement so as to now engage an interior blocking surface formed on the inner surface of the pen's upper body. The result is the deployment of the writing tip in its protracted position. When the button 30 is pressed again, the gear again rotates to clear the blocking surface as the button is released, resulting in a full retraction of the writing tip. As noted above, the many mechanisms for carrying out this function are well known in the art, and a detailed description is unneeded.

SUMMARY

The invention herein is directed to a writing instrument formed about a generally longitudinal axis, such as a pen or pencil, and having a generally longitudinally retractable tip. The writing instrument further includes a design element, such as a logo, positioned on its clip or other exterior body location. The writing instrument further includes means responsive to the longitudinal movement of the writing tip to rotate the design element into a first position when the tip is in its protracted position, and into a second position when the tip is in its retracted position. Additional details will be provided in the following Description of the Preferred Embodiment, of which the drawings form a part.

THE DRAWINGS

DESCRIPTION OF THE PREFERRED EMBODIMENT

Turning initially to FIGS. 2A and 2B, front elevation views are shown in schematic of a writing instrument constructed in accordance with the invention and with its writing tip 22 in the protracted and retracted positions, respectively. A Chevrolet logo is shown affixed to the pen's clip 14 by way of example. As illustrated in FIGS. 2A and 2B, the logo rotates approximately 90° when the tip is retracted to attain a display that is oriented generally perpendicular to the pen body. As such, the logo is optimally displayed in its normal "horizontal" position (FIG. 2B) when the pen is not being used and is, for example, clipped instead to the user's shirt pocket. When the button 30 is pressed to deploy the writing tip 22, the logo is rotated 90°. This feature is particularly beneficial for, but not limited to, logos that are wider than they are tall. Such logos are typically just printed on the pen, affixed in a less preferred fixed orientation to the pen, or affixed in the preferred orientation but made smaller than desired to avoid interference with the user's grip or hand movement when writing.

While possessing a novelty quality that commands a viewer's attention, the rotating design element of the present invention makes the pen memorable and is visually interesting. The visual effect makes the logo or other design element more memorable than a fixed logo/element as well, since it is the focus of the viewer's attention for a longer period, and commands repeated focus each time the logo/element rotates. Moreover, the rotation reorients the logo away from a position that might contact the user's hand while writing and thereby interfere with user's comfort or ability to write. Lastly, the orientation of the logo or design element is a visual indication of whether the writing tip is retracted, minimizing the risk that the pen is accidentally stored within the user's shirt pocket with its tip extended—an accident which has undoubtedly resulted in numerous ink-stained shirts being laundered each day with varying degrees of success.

Figure 1:
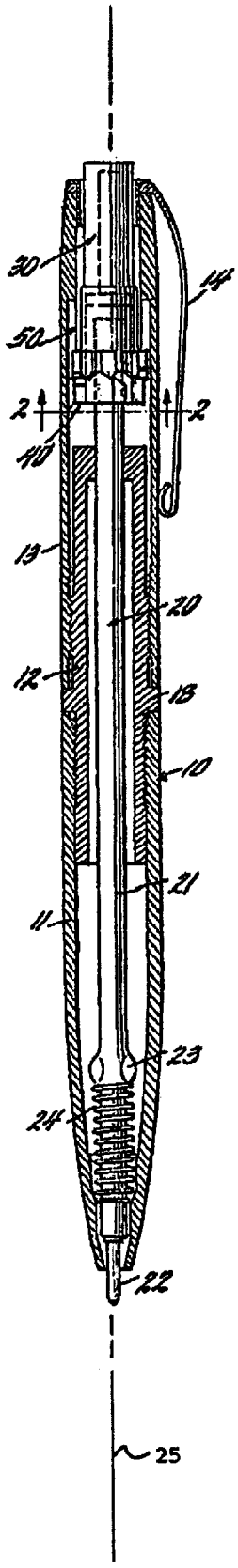
FIG. 1 (PRIOR ART)
FIG. 1 is a longitudinal sectional view of a pen constructed in accordance with the prior art.
Figure 2:
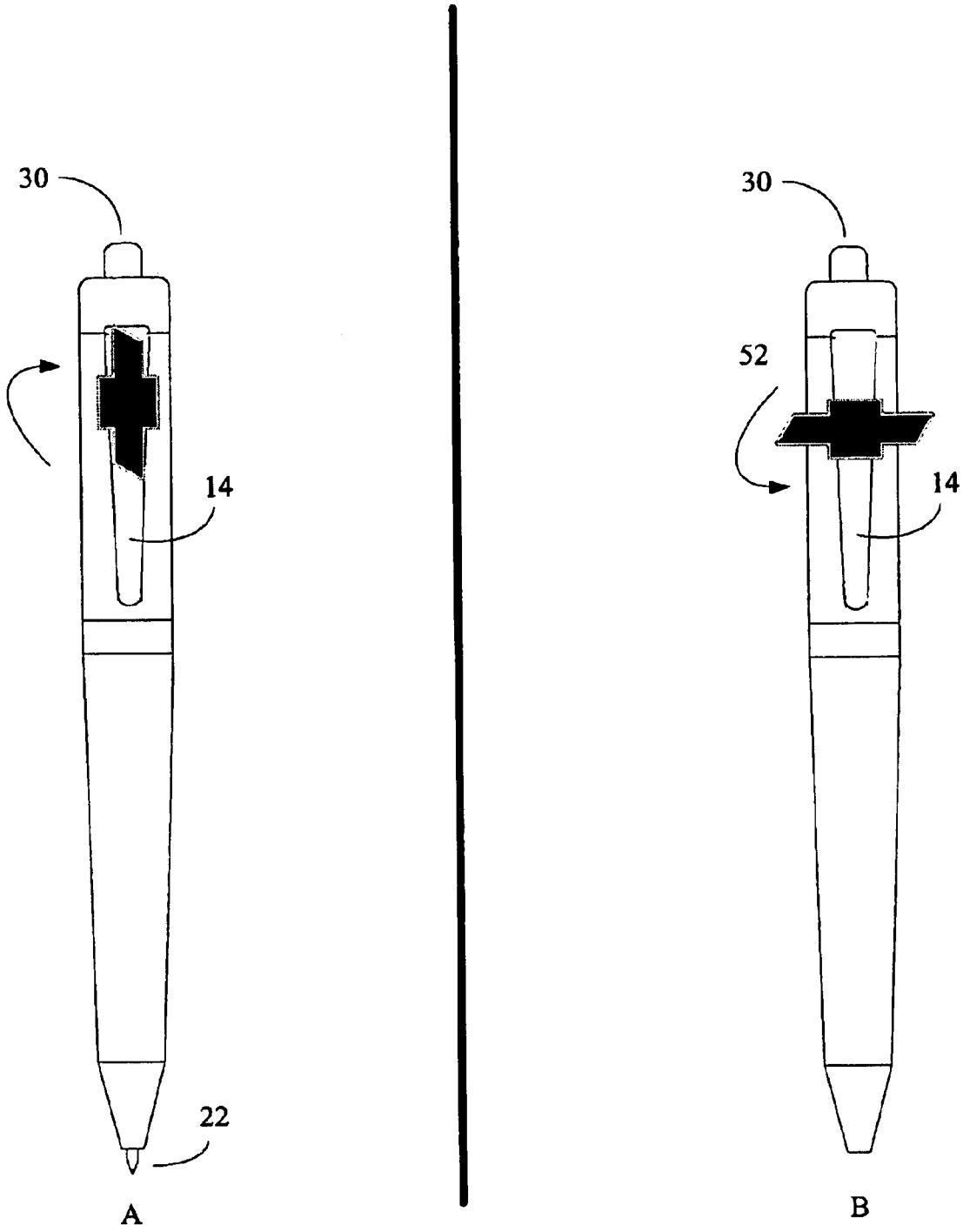
FIGS. 2A and 2B are front elevation views in schematic of a writing instrument constructed in accordance with the invention and with writing tip in its protracted and retracted positions, respectively.
Figure 3:
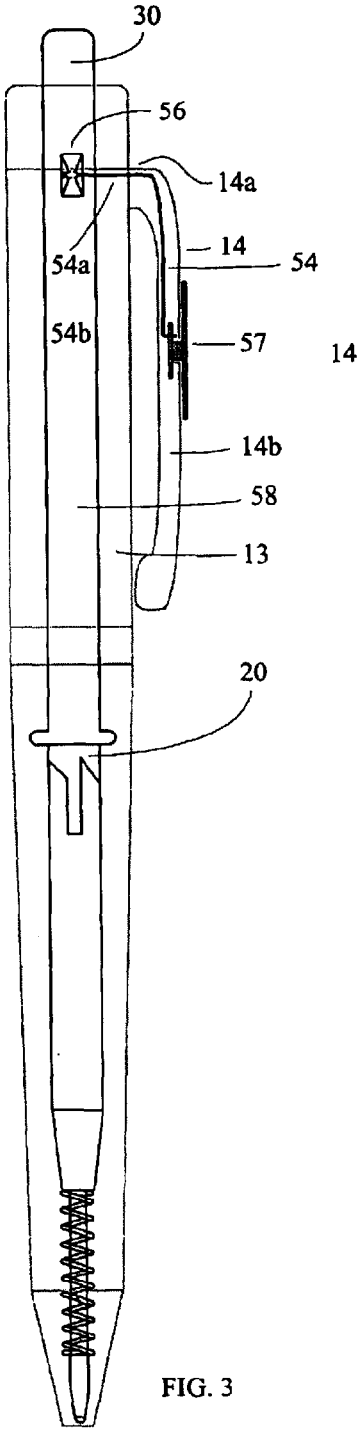
FIG. 3 is a side elevation view in schematic of a writing instrument constructed in accordance with the invention.

FIG. 3 is a side elevation view in schematic of the writing instrument of FIG. 2, illustrating the mechanism by which responsive rotation is generated. The pen's pocket clip 14 includes a generally radially-extending base portion 14*a* affixed to the upper body 13 of the pen, and a relatively longer, generally longitudinally-extending portion 14*b* which is configured to engage the user's shirt pocket in the conventional manner. The clip 14, and both its portions 14*a*, 14*b*, preferably have a generally U-shaped cross-section.

A generally "L"-shaped connection rod 54 is coupled for longitudinally responsive movement at its proximal end to the pen's cartridge unit 20 by such means as a bracket 56 attached to a generally tubular inner barrel structure 58 into which the pen's cartridge unit is inserted. The inner barrel structure may be configured simply as a longitudinally-extending cap which fits over the cartridge and may conveniently be integrally formed with the pen's button 30. Alternatively, the top end of the barrel structure can be close-ended, and can protrude through the top of the pen's upper body to perform the function of the button.

From its proximal end, the connecting rod 54 extends generally radially outward through the pen's upper body 13 via a longitudinally-extending slot that accommodates the rod's longitudinal movement. The slot is hidden behind the base 14*a* of the pen's clip 14 and is accordingly not readily visible to a person viewing the pen. The radially-extending portion of the rod 54 extends through the interior channel defined by the clip's U-shaped structure so that the rod's radially-extending segment 14*a* is substantially shielded from view. The dimensions of the clip's base 14*a* are sufficient to accommodate, and generally mask from view, the longitudinal movement of the radially-extending rod segment 14*a* that occurs when the writing tip is deployed and retracted.

As the rod's radially-extending portion 54*a* approaches the inner wall of the clip portion 14*b*, the rod 54 is bent to form a generally longitudinally-extending segment 54*b* that moves reciprocally within the longitudinally-extending portion of the clip as the writing tip is deployed and retracted. The longitudinal portion of the rod remains generally hidden from view by the clip's generally U-shaped exterior.

Figure 4:
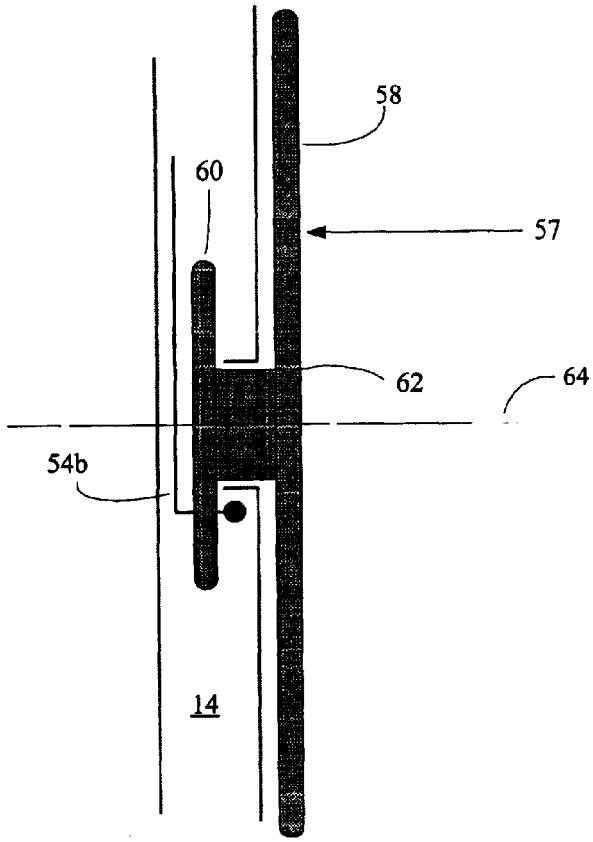
FIG. 4 is an enlarged fragmentary view, in schematic, of the rotating logo assembly of Figure.

As illustrated in FIGS. 2–4, a logo assembly 57 is mounted for rotation on the longitudinally-extending portion of the clip 54. In simplest form, and as best illustrated in FIG. 4, the logo assembly 57 preferably comprises a rotating design element 58 mounted on the exterior of the clip so as to be visible to viewers, a rotating inner disk 60 positioned within the interior channel of the clip, and a shaft 62 that mechanically couples the disk 60 to the design element 58 through a hole formed in the clip. Those of ordinary skill in the art will recognize that the design element, disk and shaft rotate about a generally radially-extending axis of rotation 64 that passes through the center of the shaft.

Figure 5A:
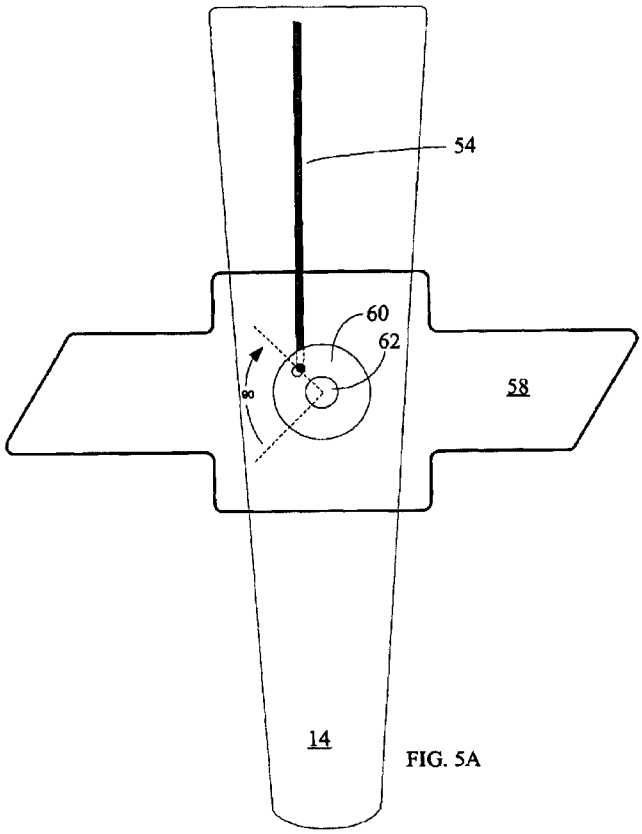
FIGS. 5A and 5B are respectively enlarged fragmentary views, in schematic, of the rotating logo assembly of FIG. 4 corresponding to the preferred protraction and retraction positions of the writing tip.
Figure 5B:
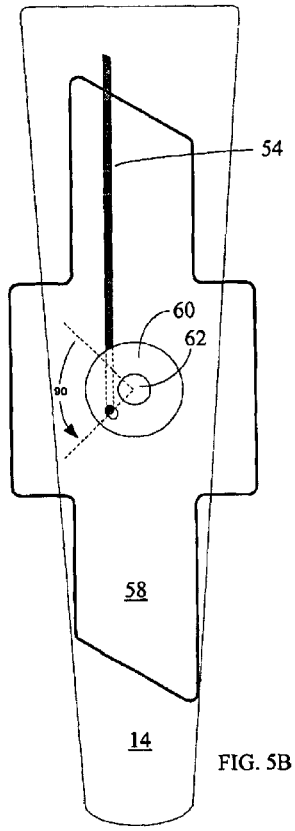

As illustrated in FIGS. 3–5, the distal end 54*b* of the connecting rod 54 is coupled to the inner disk 60 of the logo assembly a distance from the axis of rotation so that longitudinal movement of the rod's distal end exerts a torque about axis 64 on the disk, causing the disk to rotate. The disk's rotational movement is transferred through the clip 14 to the logo assembly via the shaft 62.

The degree of rotation induced by the rod is a matter of coupling the rod to the geometrically correct region of the disk. As illustrated in FIG. 5, a rotation of 90° is generated by locating the region on the disk which will move through a 90° arc in response to the longitudinal distance traveled by the connecting rod as the writing tip is deployed and retracted. Radially outward regions on the disk travel over lesser arcs than radially inner regions on the disk for a given longitudinal movement of the rod. At the same time, the amount of force required to cause the rotation increases as the point of coupling moves inward towards the axis of rotation, and the tip of the rod follows a less linear path that is tactilely less preferable. The dimensions of the disk are accordingly chosen to provide the correct balance so that the movement of the writing tip and rod are smooth and induced with an acceptable degree of force, while the degree of longitudinal rod movement causes the desired degree of logo rotation. Structures other than a disk may, of course, be employed to couple the rod to the rotating design element. Fir example, a lever may be affixed to the shaft to receive the distal end of the rod, or the shaft can be directly contacted by the rod. All of such alternative structures are within the intended scope of the invention.

While the foregoing description includes detail that will enable those skilled in the art to practice the invention, it should be recognized that the description is illustrative in nature and that many modifications and variations will be apparent to those skilled in the art having the benefit of these teachings. It is accordingly intended that the invention herein be defmed solely by the claims to be appended to the completed patent application, and that the claims be interpreted as broadly as permitted in light of the prior art.

We claim:

1. A writing instrument comprising:

a generally tubular body disposed about a longitudinal axis between proximal and distal end regions;

an ink cartridge structure having a writing tip at its longitudinally distal end for controllably dispensing a writing medium during writing;

means for imparting reciprocal longitudinal movement to the writing tip to selectively deploy the tip in a first position wherein it longitudinally extends from the tubular body to render the instrument capable of writing and for alternatively retracting the writing tip into a position within the tubular body;

a pocket clip affixed to the proximal end region of the tubular body and configured to securing the instrument to a person's pocket flap when the instrument is inserted into the pocket;

a visible design element assembly mounted for rotation on the pocket clip; and a rod having proximal and distal ends, the rod being coupled at its proximal end to the writing tip for longitudinal movement therewith, and being coupled at its distal end to the design element to induce rotation therein in response to said longitudinal movement.

2. The writing instrument of claim 1 wherein pocket clip has a channel generally hidden from view by the structure of the clip in its affixed orientation, and said rod extend through said channel so as to remain substantially hidden from view.

3. The writing instrument of claim 2 wherein the rod extends generally radially outward through the tubular body, and the tubular body includes a generally longitudinally-extending slot behind the clip sized to accommodate the longitudinal movement of the rod.

4. The writing instrument of claim 3 wherein the clip has an outer surface that is substantially visible when the clip is affixed to the pen, an inner surface that is substantially not visible when the clip is affixed top the pen, and a through-hole formed about a generally-radially extending central axis and in communication with the outer and inner surfaces, and the design element assembly includes an outward-facing design element positioned on the outer surface of the clip and a shaft coupled to the design element and passing through the hole in the clip, and the writing instrument includes means for coupling the distal end of the rod to the shaft.

5. The writing instrument of claim 4 wherein the coupling means includes a generally disk-shaped member coupled to the shaft for rotation therewith, and means for coupling the distal end of the rod to the generally disk-shaped member at a location that imparts a rotational torque to the disk about the radially-extending axis when the cartridge moves longitudinally.

* * * * *